US005391833A

United States Patent [19]

Clement

[11] Patent Number: 5,391,833

[45] Date of Patent: Feb. 21, 1995

[54] ELECTRIC STRINGED INSTRUMENT AND PROGRAMMABLE ELECTRICAL CONNECTOR THEREFOR

[76] Inventor: David C. Clement, 368 Sterling Pl., Brooklyn, N.Y. 11238

[21] Appl. No.: 46,198

[22] Filed: Apr. 14, 1993

[51] Int. Cl.[6] ..... G10H 3/12; G10H 1/18

[52] U.S. Cl. ..... 84/742

[58] Field of Search ..... 84/723, 725, 726, 735, 84/743, 742

[56] References Cited

U.S. PATENT DOCUMENTS 4,334,452 6/1982 Morrison, III et al. .
4,433,603 2/1984 Siminoff .
4,711,149 12/1987 Starr .
4,913,024 4/1990 Carriveau ..... 84/726
5,010,802 4/1991 Lanham ..... 84/743

*Primary Examiner*—William M. Shoop, Jr.
*Assistant Examiner*—Jeffrey W. Donels
*Attorney, Agent, or Firm*—Anthony J. Casella; Gerald E. Hespos

[57] ABSTRACT

An electric guitar is provided with a connector for easily replacing or rewiring magnetic transducers or other components of an electric guitar. The connector of the subject invention includes a non-conductive base with a plurality of connecting springs mounted therein. The connecting springs enable releasably electrical connection of electrical connecting wires from a magnetic transducer of an electric guitar.

15 Claims, 3 Drawing Sheets

ELECTRIC STRINGED INSTRUMENT AND PROGRAMMABLE ELECTRICAL CONNECTOR THEREFOR

BACKGROUND OF THE INVENTION

This invention relates to electrical stringed musical instruments and to an electrical connector for such instruments.

Magnetic transducers for electric instruments are located near the strings and function to convert the vibrations of a string into an electrical signal. The transducers are connected to controls on the instrument and to output jacks by hard wire soldered connections. The jacks enable connection to an amplifier for amplification and modulation of the signals.

Not all prior art magnetic transducers produce the same audio signal. For example, some transducers provide a strong midrange frequency audio signal, with only adequate amounts of bass and treble. Other transducers provide a strong high end frequency audio signal and a high treble signal. Some prior art magnetic transducers introduce significant distortion into the audio signal of the instrument, while other prior art transducers provide a substantially distortion-free audio signal. The audio signal produced by a prior art transducer also is affected by the pattern of soldered connections to the guitar controls.

A musician is likely to want to tailor acoustical output to the type of music being played. This can be done by changing from one instrument to another with a different array of transducers and/or with differently wired transducers. However, electric instruments are very expensive, and many musicians are unable to own more than one at a time.

The acoustical effects of an instrument can be altered by replacing or rewiring the transducers. However replacing or rewiring the transducer requires desoldering the wires connecting the transducer to other electric components of the instrument, and a subsequent resoldering of wires. Therefore, it is both difficult and time-consuming to replace or rewire the magnetic transducer of a prior art electric stringed instrument. The soldering clearly goes beyond the range of adjustments that could be made by a musician between sets of a performance.

The prior art includes many types plug and socket electrical connectors. However, these prior art pairs of mateable connectors have not been used in electric stringed instruments. Furthermore, these types of connectors would require uniformity among the many manufacturers of instruments and the many manufacturers of transducers. Additionally, the provision of a plug on each end of each wire in an electric stringed instrument would add significantly to the cost of the instrument.

Accordingly, it is an object of the subject invention to provide an improved electric stringed instrument which enables easy replacement or rewiring of magnetic transducers.

It is a further object of the subject invention to provide a transducer connector which is adaptable for usage on most electric stringed instrument.

Still a further object of the subject invention is to provide an electric guitar transducer connector which is compatible for use with most electric guitar transducers.

It is yet another object of the subject invention to provide an electric guitar transducer connector to enable transducer interchange in a time-efficient manner.

Still another object of the subject invention is to provide an electric guitar transducer connector which may be manufactured easily and at a low cost.

SUMMARY OF THE INVENTION

The subject invention is directed to an electric stringed instrument and to a programmable electrical connector for an electric stringed instrument. The connector of the subject invention enables easy attachment, modification and removal of transducers or other electronic components of an electric stringed instrument.

The connector of the subject invention comprises a base of a non-conductive material having opposed front and back faces. A plurality of apertures extend through the base from the front face to the back face.

The connector also includes a plurality of connecting springs securely engaged in the respective apertures of the base and projecting from at least the front face of the base. The springs are dimensioned to securely engage and electrically contact a conductive lead between two adjacent coils. The connector may further include fastening means for securely fastening the connector to a selected location in the instrument.

The subject invention may further include a magnetic shielded box with an attachable cover. The magnetic shielded box is dimensioned to receive the base and the connecting springs of the connector, and is dimensioned to be received in the instrument. The shielded box prevents electromagnetic radiation in the vicinity of the connector from affecting electrical or acoustical signals.

In use, the connector may be fastened in either a connections well or a magnetic transducer well of an electric stringed instrument. Wires from transducers and other components may be releasably electrically connected to selected springs of the connector by biasing selected springs sufficiently for insertion of a wire lead between a pair of adjacent spring coils. The biasing force is then released, and the coils resiliently grip the lead therebetween. Thus, the connector of the subject invention enables replacement and/or rewiring of a magnetic transducer or other component of an electric stringed instrument without desoldering and subsequent resoldering of the electrical connecting wires.

The connector of the subject invention enables a typical prior art magnetic transducer of an electric stringed instrument to be replaced or rewired without special tools. Thus, for example, a musician can change the acoustic effects that can be achieved with an instrument between sets of a performance.

DETAILED DESCRIPTION OF THE PREFERRED EMBODIMENT

Figure 1:
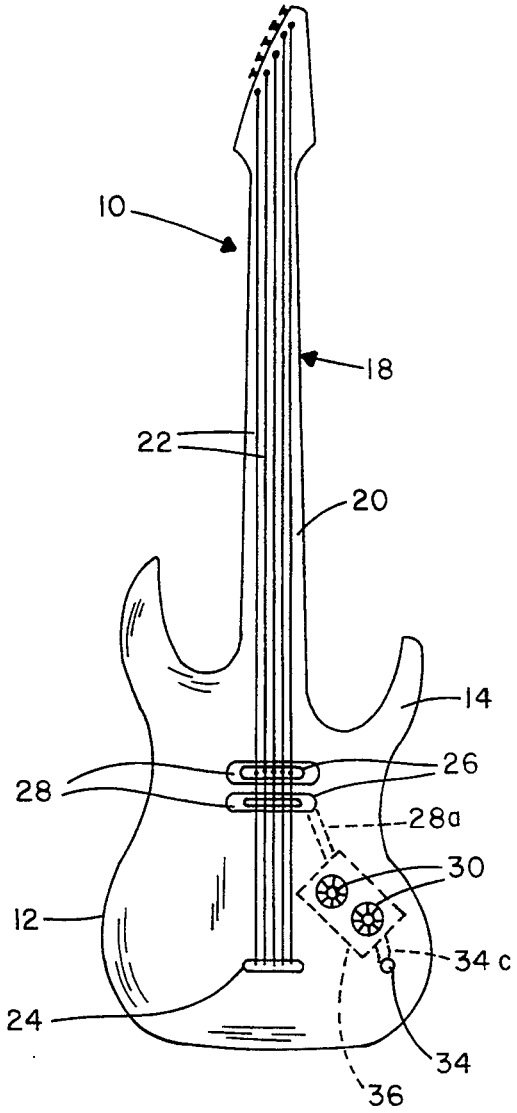
FIG. 1 is a front elevational view of a guitar in accordance with the subject invention.
Figure 2:
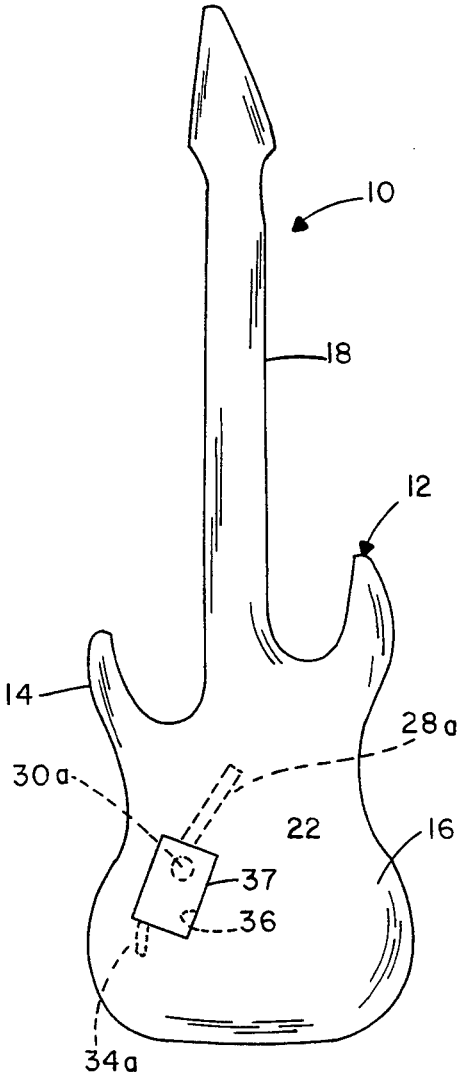
FIG. 2 is a rear elevational view of the guitar shown in FIG. 1.
Figure 3:
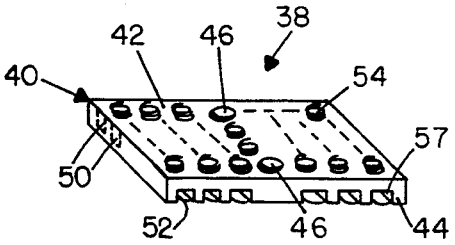
FIG. 3 is a perspective view of the connector of the subject invention.

An electric guitar in accordance with the subject invention is identified generally by the numeral 10 in FIGS. 1–3. The guitar 10 includes a substantially solid body 12 with opposed front and rear faces 14 and 16 respectively. A neck 18 extends rigidly from the body 12, and has a front face defining a fingerboard 20. A plurality of harmonic strings 22 stretch from the end of the neck 18 remote from the body 12, across the fingerboard 20 and to a bridge 24 on the front face 14 of the body 12.

Magnet transducers 26 are mounted in transducer wells 28 on the front face 14 of the body 12. The magnetic transducers 26 are operative to convert vibrations of the harmonic strings 22 into electrical signals.

The guitar 10 further includes potentiometer 30 mounted to apertures in the body 12. The potentiometer 30 include control knobs 32 projecting from the front face 14 of the body 12 for controlling at least certain aspects of signals from the transducers 26.

The body 12 of the guitar 10 further includes a jack 34 mounted to an aperture in the body 12. The jack 34 receives a plug (not shown) of a cable extending to an amplifier and power supply. The jack 34 enables signals from the transducers 26 to be amplified and modulated.

An electronic connections well 36 extends into the back face 16 of the body 12 to enable electrical connection of wire leads from the magnetic transducers 26, the potentiometer 30 and the jack 34. A cover plate 37 is releasably fastened to the rear face 14 of the body 12 to cover the electronic connections well 36. Channels **28*a*, 30*a* and 34*a* respectively extend from the connections well 36 to the transducers 28, potentiometer 30 and the jack 34. The channels enable wires from the potentiometer 30, magnetic transducers 28 and the jack 34 to be directed to the connections well 36**.

Figure 4:
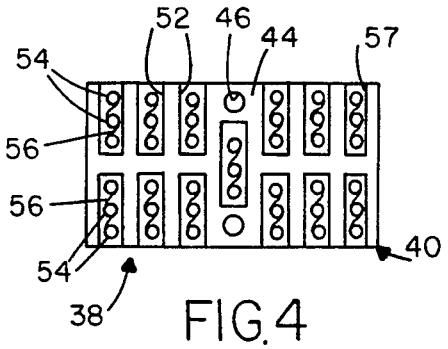
FIG. 4 is a bottom plan view of the connector shown in FIG. 3.
Figure 5:
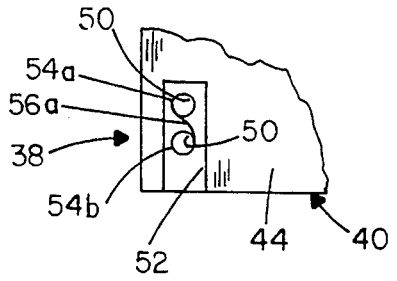
FIG. 5 is a bottom plan view of an alternate connector.

Connections of the wires are enabled by a programmable electrical connector 38 mounted in the connections well 36 as shown in FIG. 3. The connector 38 as shown in FIGS. 4 and 5 includes a base 40 formed from a non-conductive material and having opposed first and second faces 42 and 44. Mounting apertures 46 extend through the base 40 from the first face 42 to the second face 44 to enable mounting of the connector 38 to portions of the guitar body 12 which define the connections well 36. The base 40 of the connector 38 is characterized further by arrays of aperture sets 48, with each aperture set comprising a plurality of apertures 50 extending entirely through the base 40 from the first face 42 thereof to the second face 44. At least one channel 52 is defined in at least the second face 44 and extends at least between the apertures 50 in each aperture set 48.

Figure 7:
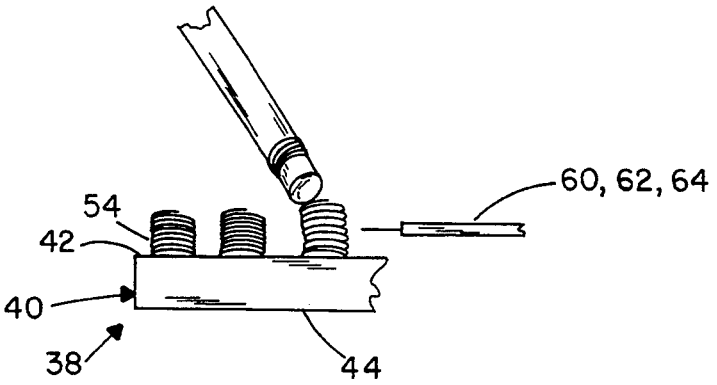
FIG. 7 is a elevational side view of a portion of the electronic connector having a connector spring delectably biased.
Figure 8:
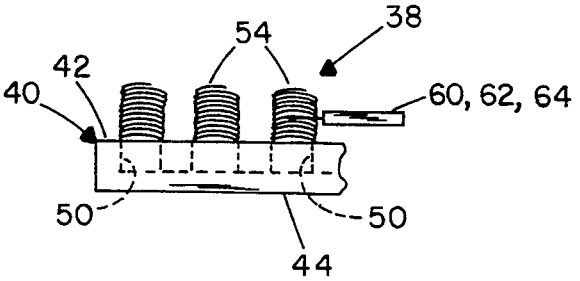
FIG. 8 is a side elevational view of the connector electrically connected to a wire.

Electrically conductive coil springs 54 are mounted in the respective apertures 50 of the base 40 to extend substantially orthogonal to the plane of the base 40. Each spring 54 extends entirely through the connector 38 from a location approximately aligned with the second face 44 of the base 40, to a location where a portion of the spring 54 projects beyond the first face 42. The total height of the connector as shown in FIGS. 7 and 8 is less than the depth of the connections well 36.

Figure 6:
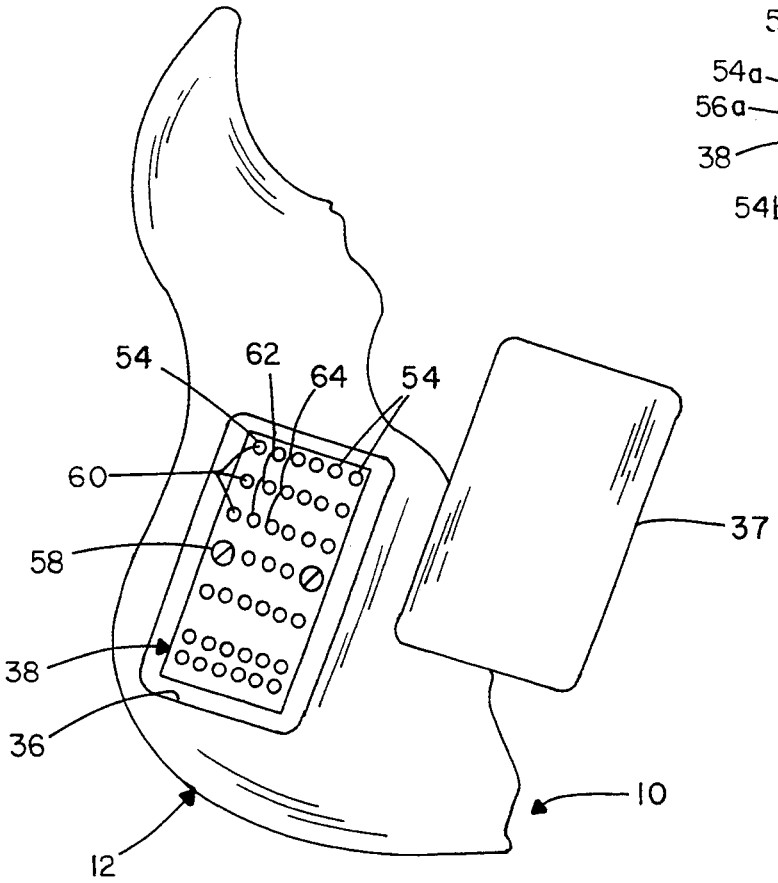
FIG. 6 is a rear elevational view of a portion of the guitar with connection well open.

The coil springs 54 in each set 48 of apertures 50 are electrically connected to one another. More particularly the coil springs 54 in each set of apertures 48 are provided with electrically conductive jumpers 56 extending along the second face 44 and through the channel 52. As shown in FIG. 5, the jumpers 56 define strips of conductive metal soldered to the springs 54. For example, each strip 56 may define a continuous solder bead in the channel 52 to connect the springs 54 in the set of apertures 48. Alternatively, as shown in FIG. 6, the jumpers 56a may be unitary parts of adjacent springs **54*a* and 54*b* in apertures 50 of a pair of apertures 48. The coil springs 54 along the second surface 44 of the electronic connector 38 and the electrically conductive jumpers 56, may be coated with an insulating material 57. The insulting material 57 electrically insulates the second face 44 of the base 40** to prevent electrical shorting.

Returning to FIG. 3, the connector 38 is fastened in the electronics connection well 36 of the electric guitar 10, by fastening screws 58 which pass through the mounting apertures 46 of the base 48 and into the guitar body 12. The connector 38 is fastened such that the first surface 42 and the coil springs 54 project outwardly towards the opening of the connections well 36.

Wires 60 from the magnetic transducers 26, wires 62 from the potentiometer 30 and wires 64 from the output jack 34 all extend to the connections well 36, and are releasably electrically connected to selected coil springs 54 of the connector 38. More particularly, as shown in FIGS. 7 and 8, the wires 60, 62 or 64 can be placed in releasable electrical contact with a spring 54 by applying a manual force transverse to the spring 54 to separate adjacent coils sufficiently for insertion of a wire 60, 62, 64 therebetween. Thereafter, as shown in FIG. 8, the connecting spring 54 is released and resiliently returns toward an undeflected position with the connecting wire 60, 62, 64 securely but releasably electrically connected between adjacent coils of the spring 54. Electrical connection of selected wires 60, 62 and/or 64 to one another is achieved by mounting the selected wires to springs 54 in a set of apertures 48. Thus, electrical connection is achieved by the jumper 56 between the springs 54 in the selected set of apertures 48. The releasable electrical connection between a connecting wire 60, 62 or 64 and a spring 54 is sufficiently strong to endure movements to which an electric guitar may be subjected. Thus, electrical signals transmitted by connecting wires 60 and 62 provide an audio output signal reliably transmitted through connecting wires 64 to an output jack 30, for transmission to an appropriate external amplification means.

The connector 38 enables wires 60, 62 and 64 to be releasably connected to appropriate conductive springs 54 for achieving a desired acoustical effect. The musician can readily access the connector 38 and disconnect at least selected wires. The magnetic transducer can then be replaced and wires 60, 62 and/or 64 can be connected to appropriate coil springs 54 in connector 38 to enable creation of different acoustic effects with the guitar 10 without resoldering.

Figure 9:
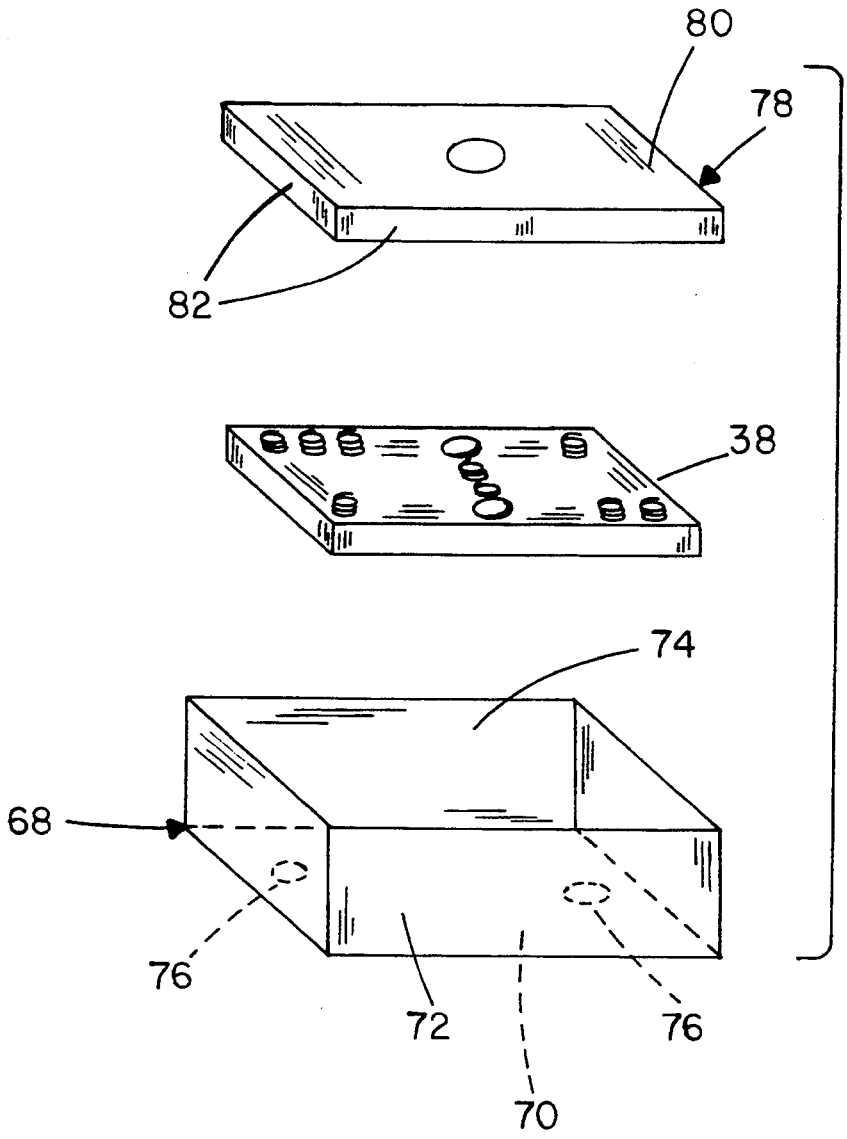
FIG. 9 is an exploded perspective view of a magnetic shielded box and connector of the subject invention.

An alternate embodiment of the subject invention, as illustrated in FIG. 9, disposes the connector 38 in a magnetic shielded box 68, which in turn is fastened within the connections well 36. The magnetic shielded box 68, is dimensioned to accommodate the connector 38 and is formed with a bottom wall 70 and side walls 72 defining an open top 74 opposite the bottom wall 70. The bottom wall 70 has mounting holes 76 disposed to register with the mounting apertures 46 of the connector 38 to enable fastening screws 58 to pass through both the mounting apertures 46 of the connector 38 and the mounting holes 76 of the shielded box 68. The magnetic shielded box 60 also includes a cover 78 dimensioned to be slidably received over the open top 74 of the magnetic shielded box 68. The cover 78 includes a planar wall 80 attached to a plurality of side walls 82 which telescope over side walls 72. The cover 78 further includes an annular aperture 84 to enable the connecting wires 60, 62, 64 to pass into the magnetic shielded box 68 for releasable electrical connection with the connector 38.

In use, the connector 38 is placed in the magnetic shielded box 68, and both are fastened in the connections well 36 with screws 58. Next, the connecting wires 60, 62, 64 are passed through the annular aperture 84 of the cover 78, and the connecting wires 60, 62, 64 are releasably electrically connected to the connector 38 as described above. The cover 78 is then placed on the magnetic shielded box 68. Finally, the magnetic transducer 18 is then fastened into the connections well 36.

Although the invention has been described with respect to a preferred embodiment, it is apparent that modifications can be made without departing from the spirit and scope of the invention as defined by the appended claims. For example, the connections may extend into the front face of the guitar and the cover may be the fingerboard extending across the front face.

I claim:

1. An electric stringed instrument comprising:

a body having means for attaching a plurality of harmonic strings, at least one transducer aperture formed in said body at a location for registration with the strings, at least one potentiometer aperture formed in said body and an electronic connections well extending into said body, at least one transducer channel formed in said body and extending from said connections well to the transducer aperture, at least one potentiometer channel form in said body and extending from said connections well to the potentiometer aperture;

at least one magnetic transducer demountably attached to said body in proximity to said transducer aperture, electrical wires attached to said magnetic transducer and extending through said transducer channel to said connections well;

at least one potentiometer mounted to said body in proximity to said potentiometer aperture, electrical wires attached to said potentiometer and extending through said potentiometer channel to said connectors well; and a programmable connector mounted in said connections well having a base with opposed first and second faces, a plurality of apertures extending through said base from said first face to second face, a plurality of electrically conductive terminals having manually deflectable contact members for resiliently engaging a wire therebetween, said contacts being mounted respectively in said apertures, such that said manually deflectable contact members project outwardly from said first face of said base, said electrical wires of said magnetic transducer and said potentiometer being in releasable electrical engagement between contact members in terminals, and jumper means for providing electrical connection between the selected terminals for electrically connecting the wires of said magnetic transducer with the wires of the potentiometer.

2. An electric stringed instrument as in claim 1, wherein said base of said connector is formed from a non-conductive material.

3. An electric stringed instrument as in claim 1, wherein said plurality of terminals comprise a plurality of arrays of connecting terminals, the terminals in each said array being permanently electrically connected to one another by said jumper means.

4. An electric stringed instrument as in claim 3, wherein the terminals in each said array, and the jumper means are unitary with one another.

5. An electric stringed instrument as in claim 3, wherein the jumper means comprise a conductive strip disposed on the second face of the base and connecting the terminals in each said array.

6. An electric stringed instrument as in claim 5, wherein the conductive strips comprise solder.

7. An electric stringed instrument as in claim 5, wherein the second face of said base comprises at least one recess, said conductive strips being disposed in said recess.

8. An electric stringed instrument as in claim 7 further comprising insulating material surrounding and enclosing said jumper means.

9. An electric stringed instrument as in claim 1, wherein the terminals are coil springs and wherein the contact members are coils of the respective springs.

10. An electric stringed instrument as in claim 1, wherein the connections well includes a cover releasably attached to said body for protectively enclosing the connector.

11. An electric stringed instrument as in claim 1 further comprising a magnetic shielded box in said connections well, said programmable connector being disposed in said magnetic shielded box.

12. An electric stringed instrument as in claim 11, wherein said magnetic shielded box comprises a bottom wall and sidewalls defining an open top opposite said bottom wall and a cover securely engageable over said open top of said magnetic shielded box.

13. An electric stringed instrument as in claim 1 further comprising an output jack mounted to the body, a channel extending from said output jack to said connections well, wires extending through said channel from said jack to said connections well and being releasably connected to selected terminals of said connector.

14. An electric guitar comprising:

a body having opposed front and back faces, a neck attached to said body, means for extending a plurality of harmonic strings between said neck and said front face of said body, an electronic connections well extending into said body for a selected depth, at least one transducer aperture extending into said front face at a location for registration with the strings, at least one potentiometer aperture and a jack aperture extending into said body, at least one transducer channel formed in said body and extending from said connections well to said transducer aperture, at least one potentiometer channel formed in said body and extending from said connections well to said potentiometer aperture and a jack channel extending from said connections well to said jack aperture;

a cover releasably mounted to said body and over said connections well;

at least one magnetic transducer removably mounted to said front face of said body adjacent said transducer aperture, electrical wires attached to said magnetic transducer and extending through said transducer channel to said connections well;

at least one potentiometer mounted on said body adjacent said potentiometer aperture, electrical wires attached to said potentiometer and extending through said potentiometer channel to said connections well;

a jack mounted to said body in proximity to said jack aperture, electrical wires attached to said jack extending through said jack channel to said connections well;

a programmable connector mounted in said connections well having a base with opposed first and second faces, a plurality of arrays of apertures extending through said base from said first face to said second face thereof, each said array of apertures comprising at least two apertures, electrically conductive coil springs mounted in each said aperture such that a plurality of coils of each said coil spring project beyond the first face of the base, said base and said springs defining a height less than the depth of the connections well, an electrical jumper for each said array of apertures, each said jumper being disposed on the second face of said base and electrically connecting and extending between the coil springs in the apertures of each said array of apertures, electrical insulating means enclosing each said electrical jumper and the coil spring connect thereto; the wires from the potentiometer, the transducer and the output jack being releasably engaged between the coils of selected springs of said programmable connector such that the springs and the associated electrical jumpers enable programmable electrical connection between the transducer, the potentiometer and the jack.

15. A programmable connector for an electric stringed instrument, said connector comprising a generally rectangular base formed from a non-conductive material and having opposed first and second faces, a plurality of arrays of apertures extending through said base from said first face to said second face thereof, channels formed in said second face and extending between the apertures of each said array, mounting apertures extending through said base from said first face to said second face for mounting said connector to said musical instrument, a plurality of coil springs securely mounted respectively in the apertures of said base, each said coil spring comprising a plurality of coils, and disposed such that selected coils project out of the respective apertures and beyond the first face of said base, electrically conductive jumper beams disposed in each said channel on said second face and connecting the coil springs in the apertures of each said array and insulating material disposed on said second face and substantially enclosing said jumpers.

* * * * *